United States Patent [19]

Wang

[11] Patent Number: 4,611,620

[45] Date of Patent: Sep. 16, 1986

[54] HYDRAULIC CIRCUIT BREAKER

[75] Inventor: Hsien B. Wang, Newport Beach, Calif.

[73] Assignee: Parker Hannifin Corporation, Cleveland, Ohio

[21] Appl. No.: 250,398

[22] Filed: Apr. 2, 1981

[51] Int. Cl.[4] ..... F15B 11/08

[52] U.S. Cl. ..... 137/100; 91/446; 137/460

[58] Field of Search ..... 137/87, 98, 100, 460, 137/498; 91/446

[56] References Cited

U.S. PATENT DOCUMENTS

| | | | |
|---|---|---|---|
| 2,744,533 | 5/1956 | Parker | 137/87 |
| 3,420,265 | 1/1969 | De Pauw | 91/446 X |
| 3,502,102 | 3/1970 | Maltby | 137/498 |
| 3,568,705 | 3/1971 | Boyadjeff | 137/87 |
| 3,587,393 | 6/1971 | Vick | 91/446 X |
| 3,685,531 | 8/1972 | Byford | 137/100 X |
| 4,274,328 | 6/1981 | Pederson | 137/460 X |

*Primary Examiner*—Robert G. Nilson
*Attorney, Agent, or Firm*—Gordon L. Peterson

[57] ABSTRACT

A hydraulic circuit breaker for use with a hydraulic device comprising a body having a supply conduit for supplying hydraulic fluid under pressure to the hydraulic device and a return conduit for carrying hydraulic fluid away from the hydraulic device. A slide valve is mounted for movement in a first chamber of the body to define a supply orifice of variable area in the supply passage and a return orifice of variable area in the return passage. The slide valve is positioned in the body as a function of the pressure drop across at least one of the orifices. A pressure responsive member is mounted for movement in the body and moves in response to the pressure drop across the supply orifice reaching a predetermined value. A movable drive member extends into both of the chambers so that it can transmit at least some of the motion of the pressure responsive member to the slide valve to move the slide valve to close the supply and return orifices.

13 Claims, 2 Drawing Figures

HYDRAULIC CIRCUIT BREAKER

BACKGROUND OF THE INVENTION

It is often necessary or desirable to provide an indication, or to take remedial action, when a leak of a predetermined magnitude develops in a hydraulic system. To accomplish this, it is necessary to continuously monitor the condition of the hydraulic system even though portions of such system may be remotely located. Leak detection is particularly important in hydraulic systems used to position the control surfaces of an aircraft. If a leak of a predetermined magnitude develops in one of the hydraulic systems of an aircraft, it is essential that such system be shut off from the source of hydraulic fluid under pressure to prevent complete loss of hydraulic fluid and possible destruction of the aircraft. A hydraulic circuit breaker or hydraulic fuse is utilized to accomplish the leak detection and shut-off functions.

In a typical hydraulic control system, it is necessary to supply hydraulic fluid to, and return hydraulic fluid from, a hydraulic device. The hydraulic device may include, for example, a hydraulic actuator for positioning a member, such as an aircraft control surface and a servovalve for controlling the hydraulic actuator.

In a hydraulic system of this type, the return flow is a function of the supply flow if there are no leaks in the system. Accordingly, leak detection for this type of system can be accomplished by comparing the supply and return flows.

For example, Byford U.S. Pat. No. 3,685,531 shows a hydraulic circuit breaker which compares supply and return flows and shuts off the supply flow if the supply flow exceeds the return flow by a predetermined amount.

With the patented device supply and return flows are measured by a slide valve which is positioned so as to maintain the pressure drops across supply and return orifices substantially constant. A separate spool valve is responsive to the ratio of the pressure drops across the two orifices reaching a predetermined value for closing the supply conduit. Thus the patented device uses two separate slide valves.

SUMMARY OF THE INVENTION

The patented hydraulic circuit breaker functions very satisfactorily. However, this invention provides a hydraulic circuit breaker of greatly simplified construction. For example, this invention utilizes a single slide valve, not only to maintain the pressure drops across supply and return orifices substantially constant, but also to close at least the supply passage in response to a leak of a predetermined magnitude. Accordingly, this invention eliminates one of the two slidable valves utilized heretofore in the patented circuit breaker.

The hydraulic circuit breaker of this invention may include, for example, a body having a supply conduit for supplying hydraulic fluid under pressure to a hydraulic device and a return conduit for carrying hydraulic fluid away from the hydraulic device. Supply and return orifices are defined in the supply and return conduits, respectively. Means responsive to the pressure drop across at least one of the orifices varies the areas of the orifices to maintain the pressure drops across these orifices substantially constant over a range of flow rates. Means is provided which is responsive to the pressure drop across the supply orifice reaching about a predetermined value for substantially closing the supply orifice.

With this invention, the supply orifice is closed in response to a leak of a predetermined magnitude whereas, with the patented device discussed above, the supply conduit is closed at a location spaced from the supply orifice. Both orifice area control and supply orifice closing are advantageously accomplished with a single slide valve.

The means for varying the orifice area serves, in effect, as a flow measurement device to measure the supply and return flows. This function can advantageously be performed by a single slide valve. Slide valve position controls orifice area, and the slide valve is positioned primarily in response to the pressure drop across the return orifice, although the pressure drop across the supply orifice has some minor influence on slide valve position A pressure responsive member can advantageously be used to sense the pressure drop across the supply orifice and to move in response to the pressure drop reaching a predetermined magnitude. Movement of the pressure responsive member begins when the pressure drop exceeds a predetermined threshold level. At least some of such movement of the pressure responsive member is transmitted to the slide valve to cause the slide valve to close the supply orifice. Thus, the supply orifice is closed in response to the pressure drop across the supply orifice exceeding a predetermined magnitude. To simplify construction of the circuit breaker, the pressure responsive member and the slide valve are preferably coaxial and are mounted for axial movement.

Surges across the supply orifice may momentarily establish a pressure drop across the supply orifice that exceeds the threshold level established for closure of the circuit breaker. However, various time delaying techniques can be employed to immunize the circuit breaker from instantaneous relatively high pressure drops across the supply orifice. For example, lost motion can be provided between the pressure responsive member and the slide valve such that the initial motion of the pressure responsive member is not transmitted to the slide valve.

If a large leak occurs in the hydraulic system, the flow across the supply orifice will increase and the flow across the return orifice will be much less than the flow across the supply orifice. This results in an unacceptably large pressure drop across the supply orifice, consequent sensing of this unacceptably large pressure drop by the pressure responsive member, and a resulting movement of the slide valve to close at least the supply orifice.

Some leakage from the hydraulic system is to be expected and is considered "normal." The circuit breaker should not be so sensitive as to shut off the system in response to this normal leakage. The sensitivity of the circuit breaker can be controlled in various ways to cause it to shut off the hydraulic circuit only in response to a leak of at least a predetermined amount.

The invention, together with further features and advantages thereof, may best be understood by reference to the following description taken in connection with the accompanying illustrative drawing.

DESCRIPTION OF THE PREFERRED EMBODIMENT

Figure 1:
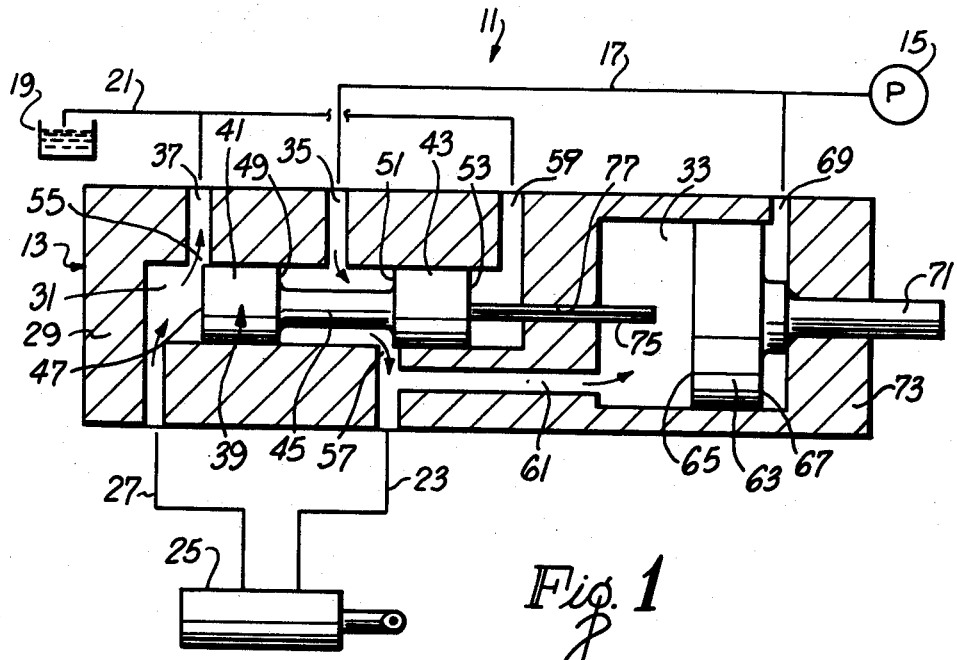
FIG. 1 is a schematic view partially in section illustrating a preferred form of hydraulic circuit breaker during normal operation.

FIG. 1 shows a hydraulic system 11 which includes a hydraulic circuit breaker 13 constructed in accordance with the teachings of this invention. The hydraulic circuit breaker 13 is adapted for use with virtually any kind of hydraulic system which utilizes supply and return flows, and the hydraulic system 11 is merely illustrative.

The system 11 includes a pump 15 for providing hydraulic fluid under pressure via a supply line 17 to the circuit breaker 13 and a reservoir 19 for receiving return flow from the circuit breaker via a return line 21.

Fluid at supply pressure flows from the circuit breaker 13 through a conduit 23 to an actuator system 25 and returns from the actuator system 25 to the circuit breaker through a conduit 27. The actuator system 25 may be conventional, and as such, it may include the usual balanced or unbalanced linear hydraulic actuator and a spool valve to control the position of the linear actuator. The spool valve may in turn be controlled, for example, by an electro-hydraulic valve. Actuator systems of this type are well known and are shown, for example, in York et al U.S. Pat. No. 3,439,707. The actuator system 25 may be used to move or position various members, such as the control surface of an aircraft.

The circuit breaker 13 is positioned between the pump 15 and the actuator system 25 so that it can detect and respond to leakage of more than a predetermined magnitude in any part of the actuator system 25. Although the circuit breaker 13 can be of various different constructions, in the embodiment illustrated, it includes a body 29 having chambers 31 and 33 therein. The body 29 also has a supply passage or conduit 35 and a return passage or conduit 37 which pass through the chamber 31 to provide communication between the supply line 17 and the conduit 23 and the conduit 27 and the return line 21, respectively.

A slide valve 39 is mounted for slidable movement in the chamber 31. The slide valve 39 includes lands 41 and 43 integrally interconnected by a stem 45 of reduced diameter. The land 41 has pressure responsive faces 47 and 49, and the land 43 has pressure responsive faces 51 and 53.

The land 41 cooperates with the wall of the chamber 31 and the return passage 37 to define a variable area return orifice 55 in the return passage 37. Similarly, the land 43 cooperates with the chamber 31 and the supply passage 35 to define a variable area supply orifice 57 in the supply passage 35. The axial position of the slide valve 39 in the chamber 31 determines the areas of the return orifice 55 and the supply orifice 57. The areas of the orifices 55 and 57 both increase as the slide valve 39 is moved to the right as viewed in FIG. 1, and both of these areas decrease as the slide valve is moved to the left. The areas of the orifices 55 and 57 may be the same or different; however, preferably the orifices vary in size so that the pressure drops across the orifices during normal operation of the valve are substantially constant. The pressure drop across the supply orifice 57 during normal operation may be equal to, or different from, the pressure drop across the return orifice 55.

A passage 59 in the body 29 provides communication between the face 53 of the slide valve 39 and hydraulic fluid at return pressure downstream of the return orifice 55. A passage 61 in the body 29 provides communication between the supply passage 35 downstream of the supply orifice 57 and the chamber 33.

A pressure responsive member in the form of a piston 63 is mounted for sliding movement in the chamber 33. The piston 63 has a face 65 which is exposed to fluid at supply pressure downstream of the supply orifice 57 via the passage 61 and a face 67 which is exposed to fluid at supply pressure upstream of the supply orifice 57 through a port 69. A rod 71 is coupled to the face 67 of the piston 63 and projects through an end wall 73 of the body 29, and consequently, the area of the face 67 exposed to fluid under pressure is less than the area of the face 65 exposed to fluid under pressure.

Figure 2:
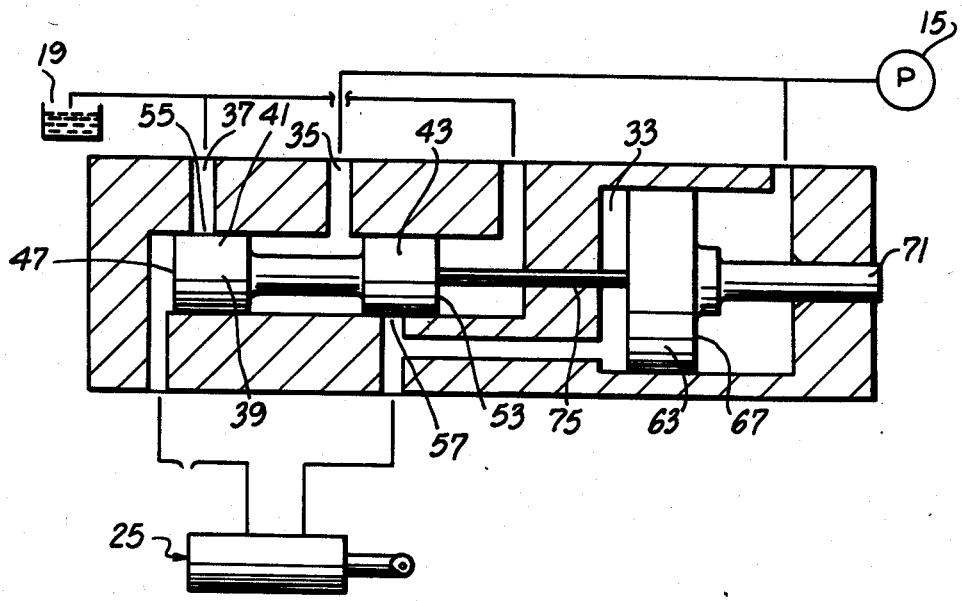
FIG. 2 is a view similar to FIG. 1 showing the hydraulic circuit breaker in the shut-off condition and with a break in the return conduit.

A drive rod 75 is mounted for sliding movement in a bore 77 of the body 29 and may have any relationship to the face 53 which will permit the rod 75 to apply a force to the face 53 which tends to urge the slide valve 39 to the left as viewed in FIGS. 1 and 2. The opposite ends of the drive rod 75 project into the chambers 31 and 33, respectively. The slide valve 39, the piston 63, the drive rod 75 and the chambers 31 and 33 are all preferably coaxial. The drive rod 75 has a length which is less than the spacing between the faces 53 and 65 during normal operation of the hydraulic system 11.

During operation of the hydraulic system 11, the slide valve 39 serves, in effect, to measure or compare the flows through the supply passage 35 and the return passage 37. To accomplish this, the slide valve 39 is automatically moved axially in the chamber 31 to vary the areas of the return orifice 55 and the supply orifice 57 so as to maintain the pressure drops across each of these orifices substantially constant.

The slide valve 39 is axially positioned in the chamber 31 by forces acting on the faces 47 and 53. In this regard, the faces 49 and 51, in the embodiment illustrated, are of equal area and are exposed to hydraulic fluid at supply pressure and, therefore, exert no net force in the axial direction on the slide valve 39. The pressure responsive face 47 is subjected to hydraulic fluid in the return passage 37 upstream of the return orifice 55. This tends to move the slide valve 39 to the right as viewed in FIG. 1. Opposing this force is the force resulting from fluid pressure which exists in the return passage 37 downstream of the return orifice 55 acting over an annular area of the pressure responsive face 53. In addition, the right end of the drive rod 75 is exposed to hydraulic fluid at the pressure which exists in the supply passage 35 downstream of the supply orifice 57. This urges the drive rod 75 to the left into contact with a central region of the face 53. Accordingly, the axial position of the slide valve 39 is a function of return pressure on both sides of the return orifice 55 and supply pressure downstream of the supply orifice 57. Consequently, the axial position of the slide valve 39 is a function of the pressure drop across both of the orifices 55 and 57 during normal operation of the hydraulic system 11. However, as a practical matter, the diameter of the rod 75 is small, and so the primary control of the axial position of the slide valve 39 is the pressure drop across the return orifice 55

During normal operation, the piston 63 is held to the righthand end of the chamber 33 by hydraulic fluid at supply pressure downstream of the supply orifice 57 acting on the face 65. Fluid at supply pressure upstream of the supply orifice 57 acts on the face 67, but in view of the differential areas of the faces 65 and 67 the piston 63 is held to the right as viewed in FIG. 1.

During normal operation of the hydraulic system 11, the leakage of hydraulic fluid from the actuator system 25 is less than a predetermined amount. If a leak greater than the predetermined amount occurs in the actuator system 25, the flow of hydraulic fluid through the supply orifice 57 will exceed the flow of hydraulic fluid through the return orifice 55 by greater than a predetermined amount. The area of the supply orifice 57 is controlled primarily by the pressure drop across the return orifice and, therefore, the area of the supply orifice is not increased. The increased flow through the supply orifice 57 produces a greater pressure drop and, consequently, the fluid pressure in the chamber 33 acting on the face 65 is reduced. This enables the fluid at supply pressure upstream of the supply orifice 57 to urge the piston 63 to the left toward the position shown in FIG. 2. After a predetermined amount of axial movement, the piston 63 engages the righthand end of the drive rod 75 and pushes the drive rod and the slide valve 39 to the left to the shut-off position shown in FIG. 2. In this position, the lands 41 and 43 of the slide valve 39 completely close and shut off the orifices 55 and 57, respectively, to hydraulically isolate the leaking actuator system 25 from the pump 15 and the reservoir 19. The piston 63 will hold the slide valve 39 in the shut off position until the circuit breaker 13 is reset.

It can be seen, therefore, that the slide valve 39 performs two important functions. First, the slide valve 39 measures or compares supply and return flow. Secondly, the slide valve 39 closes the orifices 55 and 57 if leakage from the actuator system 25 exceeds a predetermined magnitude.

The drive rod 75 also performs two functions. First, it applies a force to the slide valve 39 during normal operation as described above with reference to FIG. 1 which helps position the slide valve to control the areas of the variable area orifices 55 and 57. Secondly, in a failure mode, it serves as a power transmission element to drivingly couple the piston 63 and the slide valve 39.

During normal operation of the hydraulic system 11, the piston 63 is spaced axially from the drive rod 75. This provides, in effect, some lost motion which allows the piston 63 to move somewhat to the left without driving the slide valve 39. With this arrangement, momentary surges through the supply orifice 57 resulting in an increased pressure drop across that orifice will not move the slide valve 39 to the shut-off position of FIG. 2.

If desired, the movement of the rod 71 can be used to provide a signal indicating whether the hydraulic system is operating normally or in a shut-off mode.

For start up it is necessary to pressurize the chamber 33 to urge the piston to the position of FIG. 1, and this can be accomplished in different ways. For example, the chamber 33 to the left of the piston 63 could be provided with fluid at supply pressure from the pump 15, and the chamber 33 to the right of the piston 63 could be vented.

For example, with fluid under pressure acting on the face 65 of the piston 63, the piston 63 cannot preclude movement of the slide valve 39 to the right, If, at start up, the slide valve 39 happened to be in the position of FIG. 2, the fluid at supply pressure would also be applied via the passages 61 and 23 to the actuator 25. Normal leakage through the actuator 25 would produce pressure at the face 47 sufficient to overcome the pressure acting on the right end of the small diameter rod 75. When this occurs, the slide valve 39 would be moved to the right by these differential fluid forces to essentially the position of FIG. 1. The resetting technique forms no part of this invention.

Although an exemplary embodiment of the invention has been shown and described, many changes, modifications and substitutions may be made by one having ordinary skill in the art without necessarily departing from the spirit and scope of this invention.

I claim:

1. A hydraulic circuit breaker for use with a hydraulic device comprising:

means defining a supply conduit for supplying hydraulic fluid under pressure to the hydraulic device;

means defining a return conduit for carrying hydraulic fluid away from the hydraulic device;

means defining a supply orifice in said supply conduit through which the fluid can flow, the flow of fluid through said supply orifice causing a first pressure drop;

means defining a return orifice in said return conduit through which the fluid can flow, the flow of fluid through said return orifice causing a second pressure drop;

means responsive to at least one of said pressure drops for varying the areas of said orifices to maintain said pressure drops substantially constant over a range of flow rates during normal operation; and means responsive to at least said first pressure drop reaching about a predetermined value for substantially closing said supply orifice to terminate flow through the supply orifice to the hydraulic device.

2. A hydraulic circuit breaker as defined in claim 1 including a slide valve, and wherein said supply orifice defining means includes a first surface region on the slide valve and said return orifice defining means includes a second surface region on the slide valve, said closing means is responsive to said first pressure drop reaching about said predetermined value for moving said slide valve to cause said first and second surface regions to substantially close said supply orifice and said return orifice, respectively.

3. A hydraulic circuit breaker as defined in claim 2 wherein said varying means is responsive to at least said one pressure drop to move said slide valve to cause said first and second surface regions to vary the areas of the supply orifice and the return orifice, respectively, to maintain said pressure drops substantially constant over said range of flow rates during normal operation.

4. A hydraulic circuit breaker as defined in claim 2 wherein the closing means includes a pressure responsive member responsive to said first pressure drop.

5. A hydraulic circuit breaker as defined in claim 4 wherein the pressure responsive member moves at least when said first pressure drop reaches about said predetermined value and said closing means includes movable means between the pressure responsive member and the slide valve for transmitting at least some of such movement of the pressure responsive member to the slide valve to move the slide valve to cause the first and second surface regions to close said supply orifice and said return orifice, respectively.

6. A hydraulic circuit breaker as defined in claim 5 wherein the closing means includes lost motion means between the pressure responsive member and the slide valve so that the pressure responsive member can move at least a predetermined amount without moving the slide valve.

7. A hydraulic circuit breaker as defined in claim 1 including a slide valve and wherein said supply orifice defining means includes a first surface region on the slide valve and said return orifice defining means includes a second surface region on the slide valve and wherein said varying means includes means for moving said slide valve, and the closing means includes a pressure responsive member essentially coaxial with the slide valve.

8. A hydraulic circuit breaker for use with a hydraulic device comprising:

a body having a supply conduit for supplying hydraulic fluid under pressure to the hydraulic device and a return conduit for carrying hydraulic fluid away from the hydraulic device, said body having a first chamber therein communicating with said supply conduit and said return conduit, and said body having a second chamber therein;

a slide valve movable in the first chamber of said body to at least partially define a supply orifice of variable area and a return orifice of variable area in the supply and return passages, respectively, with the areas of said orifices being a function of the position of the slide valve in said chamber;

means for positioning the slide valve as a function of the pressure drop across at least the return of the orifices;

a pressure responsive member movable in said second chamber, said pressure responsive member having first and second faces;

conduit means for providing communication between said first face of said pressure responsive member and the supply conduit downstream of said supply orifice;

conduit means for providing communication between said second face of the pressure responsive member and hydraulic fluid upstream of said supply orifice whereby said pressure responsive member is axially movable in response to the pressure drop across said supply orifice exceeding a predetermined magnitude; and a drive member movable in said body between said slide valve and said pressure responsive member for transmitting axial movement from the pressure responsive member to the slide valve.

9. A hydraulic circuit breaker as defined in claim 8 wherein said positioning means includes said drive member.

10. A hydraulic circuit breaker as defined in claim 8 wherein said drive member extends into both of said chambers and provides lost motion means for allowing a predetermined amount of axial movement of the pressure responsive member to occur before the pressure responsive member can drive the slide valve through the drive member.

11. A hydraulic circuit breaker as defined in claim 8 wherein said slide valve, said pressure responsive member and said drive member are all coaxial.

12. A hydraulic circuit breaker for use with a hydraulic device comprising:

a body having a supply conduit for supplying hydraulic fluid under pressure to the hydraulic device and a return conduit for carrying hydraulic fluid away from the hydraulic device, said body having a first chamber therein communicating with said supply conduit and said return conduit, and said body having a second chamber therein;

a slide valve movable in the first chamber of said body to at least partially define a supply orifice of variable area and a return orifice of variable area in the supply and return passages, respectively, with the areas of said orifices being a function of the position of the slide valve in said first chamber;

means for positioning the slide valve as a function of the pressure drop across at least one of the orifices whereby the pressure drops across the orifices are controlled;

conduit means for providing communication between said second chamber and the supply conduit downstream of said supply orifice;

said positioning means including a drive member movable in said body between the slide valve and said second chamber, said drive member being exposed to the fluid pressure in the second chamber and engageable with the slide valve whereby the fluid pressure in the second chamber influences the position of the slide valve; and means responsive to at least the pressure drop across the supply orifice reaching about a predetermined value for moving the slide valve to substantially close the supply orifice and the return orifice.

13. A hydraulic circuit breaker as defined in claim 12 wherein said moving means includes said drive member and means for moving said drive member to move the slide valve to a position in which the supply and return orifices are substantially closed by the supply valve.

* * * * *